United States Patent [19]

Vallerand

[11] Patent Number: 4,811,531

[45] Date of Patent: Mar. 14, 1989

[54] METHOD AND DEVICE FOR PLUGGING A HOLE

[76] Inventor: Ivan Vallerand, 46 Lakeview Ave., Waltham, Mass. 02154

[21] Appl. No.: 107,555

[22] Filed: Oct. 13, 1987

[51] Int. Cl.[4] ..... E04G 23/02

[52] U.S. Cl. ..... 52/127.5; 52/514; 52/741; 52/749

[58] Field of Search ..... 52/514, 517, 302, 403, 52/749, 741, 743, 169.1, 127.1, 127.5

[56] References Cited

U.S. PATENT DOCUMENTS

| | | | |
|---|---|---|---|
| 3,699,854 | 10/1972 | Doherty | 52/514 X |
| 3,936,988 | 2/1976 | Miceli | 52/514 |
| 3,999,347 | 12/1976 | Devlim | 52/514 |
| 4,016,696 | 4/1977 | Mess | 52/514 |

*Primary Examiner*—J. Karl Bell

*Attorney, Agent, or Firm*—Irving M. Kriegsman

[57] ABSTRACT

A device for inserting a cork plug into a hole to a predetermined depth, the hole having a diameter d and having been made in the concrete foundation of a building for termite control purposes, the device including in one embodiment a rod for partial insertion into the hole having a bottom end and a cross-sectional diameter less than d. A pin is mounted on the bottom end of the rod so that a cork plug may be mounted thereto. Depth-setting means having a length greater than d is mounted to said rod for varying the extent to which the rod may be inserted into the hole. In one variation of this embodiment, the rod has a plurality of transverse holes uniformly spaced along its longitudinal axis and the depth-setting means includes a depth-setting pin for removable insertion into one of the transverse holes and a depth-setting cap removably mounted to the depth-setting pin for use in securing the depth-setting pin in the selected transverse hole. In another variation of the same embodiment, the rod has an externally threaded region and the depth-setting means includes a winged nut for threaded engagement on said externally threaded region.

15 Claims, 2 Drawing Sheets

METHOD AND DEVICE FOR PLUGGING A HOLE

BACKGROUND OF THE INVENTION

The present invention relates generally to a hole plugging device and more particularly to a device and method for inserting a cork plug into a hole drilled in the concrete foundation of a building for termite control purposes.

The professional extermination of termites from an infested building can at times be both time-consuming and tedious. Typically, a professional exterminator begins the treatment of an infested building by drilling a series of holes through the concrete foundation of the building to the underlying soil. The holes, which are usually uniformly spaced and disposed along the entire periphery of the concrete foundation, are made to provide the exterminator with direct access to the underlying soil. Using the holes as conduits to the underlying soil, the exterminator pours a measured volume of a termite-killing agent, such as Dursban-TC, into each hole. The termite-killing agent passes through the hole and is absorbed by the soil to form an impenetrable barrier between the concrete foundation and the underlying soil. The barrier utilizes the principle that termites inside a building must return to soil within 48 hours to avoid death by dehydration. Accordingly, those termites that are trapped inside the building by the barrier die of dehydration within days. In addition to ridding the building of termites, the barrier also keeps the building termite-free by preventing a future influx of termites.

Having introduced the termite-killing agent to the soil, the exterminator then embarks on the process of filling the holes made in the concrete foundation. Typically, the exterminator begins by inserting a cork plug into each hole to a desired depth. After plugging all the holes, the exterminator then pours concrete into each hole to fill that portion of the hole above the plug. As can easily be recognized, these steps can be very time consuming and tedious. For example, the exterminator must bend over at each hole to insert the plug. Moreover, the exterminator must relay on his fingers as the sole means for pushing the cork plug down into the hole to the desired depth, which is typically a few inches.

In U.S. Pat. No. 2,604,170 to L. A. Leffler, there is disclosed a device for plugging oil well casings, the device comprising an expandable plug and a pipe string for lowering said expandable plug into said oil well casing.

In U.S. Pat. No. 3,425,733 to W. O. Hollingsworth, there is disclosed a device for inserting a plate into a coke oven standpipe, the device comprising an elongated tubular body having a ram fixed to the lower end of said body. A rod is mounted within said body which rotates and moves axially of the body. A tab is located at the lower end of that rod which projects below the ram. Movement of the tab engages the plate against the ram.

Other known patents of interest include U.S. Pat. No. 4,457,549 to J. Lowery, U.S. Pat. No. 4,183,570 to M. W. Broyles et al., U.S. Pat. No. 4,502,722 to C. J. Rocquin, U.S. Pat. No. 3,295,840 to H. Banks Jr., U.S. Pat. No. 4,595,223 to R. L. Hawie, U.S. Pat. No. 4,615,555 to J. E. Bateham, U.S. Pat. No. 4,210,353 to B. L. Koontz, U.S. Pat. No. 4,249,763 to R. Provencher et al., U.S. Pat. No. 3,183,031 to G. C. Haberstick, U.S. Pat. No. 4,563,029 to L. L. Luberacki, U.S. Pat. No. 4,586,741 to G. J. Muti, and U.S. Pat. No. 3,601,966 to B. J. Kerry.

It is therefore an object of the present invention to provide a new and improved device for inserting a cork plug into a hole made in the concrete foundation of a building for termite control purposes.

It is another object of the present invention to provide a device as described above that is easy to manufacture, can be mass produced, and is easy to operate.

It is still another object of the present invention to provide a device as described above that eliminates the need to bend down.

It is still yet another object of the present invention to provide a device as described above that has a minimal number of parts.

It is still yet a further object of the present invention to provide a device as described above that is capable of inserting a cork plug into a hole to a pre-determined depth.

It is still yet an even further object of the present invention to provide a method for inserting a cork plug into a hole made in the concrete foundation of a building for termite control purposes.

SUMMARY OF THE INVENTION

A device for inserting a cork plug into a hole drilled in the concrete foundation of a building for termite control purposes constructed according to the teachings of the present invention includes in one embodiment an elongated rod having a top end and a bottom end. The cross-sectional diameter of the rod is smaller than that of the hole to permit its insertion into the hole. A pin for mounting a cork plug is mounted on the bottom end of the rod. Depth-setting means for varying the extent to which the rod may be inserted into the hole is also mounted on the rod. In another embodiment, the device also includes a rod having a top end and a bottom end. However, the rod has a cross-sectional diameter greater than that of the hole to prevent its insertion into the hole. An extension piece for insertion into the hole is mounted on the bottom end of the rod. The extension piece has a top end and a bottom end, the cross-sectional diameter of the extension piece being smaller than that of the hole. A pin for mounting a cork plug is mounted on the bottom end of the extension piece. In a third embodiment, the rod and the extension piece form a unitary structure.

The present invention is also directed to a method for inserting a cork plug into a hole to a pre-determined depth, the hole having been made in the concrete foundation of a building for termite control purposes and the cork plug being sized to frictionally engage the sidewall of the hole. The method includes the steps of providing a device which is insertable into the hole to the predetermined depth, mounting the cork plug on the end of the device, inserting the device with the cork plug mounted thereon into the hole to the pre-determined depth, the cork plug frictionally engaging the sidewall of the hole, and then removing the device from the hole, whereby the cork plug will remain in the hole at the predetermined depth.

Various features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which like reference numerals or characters represent like parts and wherein.

DETAILED DESCRIPTION OF PREFERRED EMBODIMENTS

The present invention is directed to a device for inserting a cork plug into a hole to a pre-determined depth, the hole having been drilled in the concrete foundation of a building for termite control purposes. Several embodiments of the invention will hereinafter be described. In one embodiment, the device includes a rod having a cross-sectional diameter less than the hole diameter and adjustable depth-setting means mounted on the rod for limiting the extent to which the rod may be inserted into the hole. In one version of this embodiment, the rod includes a plurality of transverse holes along its length and the depth-setting means includes a depth-setting pin adapted for removable insertion into any one of the transverse holes. In another version of the same embodiment, the rod includes an externally threaded region and the depth-setting means includes a winged nut adapted for threaded engagement on said rod. In a second embodiment, the device includes a rod having a diameter which is greater than the hole diameter. An extension piece having a diameter less than the hole diameter is mounted on the bottom of the rod. In a third embodiment, the rod and the extension piece are sized as in the second embodiment but are in the form of a unitary structure.

Figure 1:
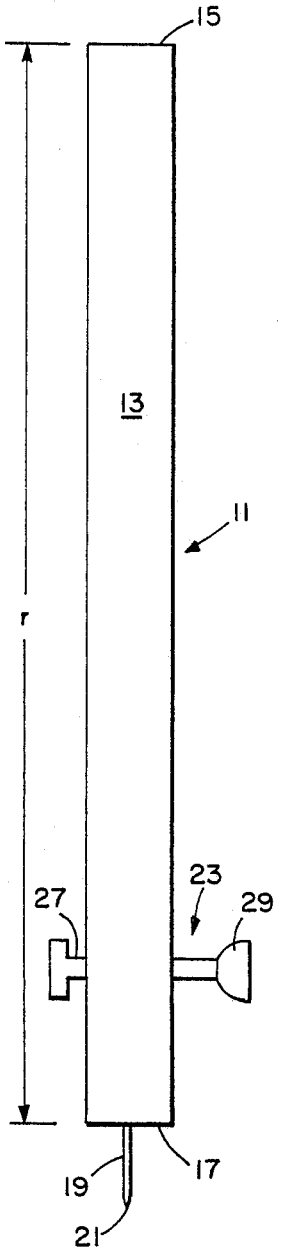
FIG. 1 is a side view of a device constructed according to one embodiment of the present invention for inserting a cork plug into a hole to a predetermined depth, the hole being drilled in the concrete foundation of a building.
Figure 2:
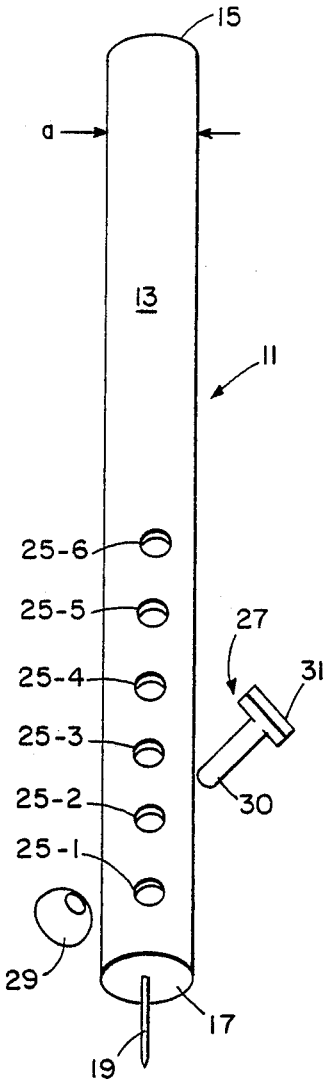
FIG. 2 is a perspective view partly exploded of the device shown in FIG. 1.
Figure 3:
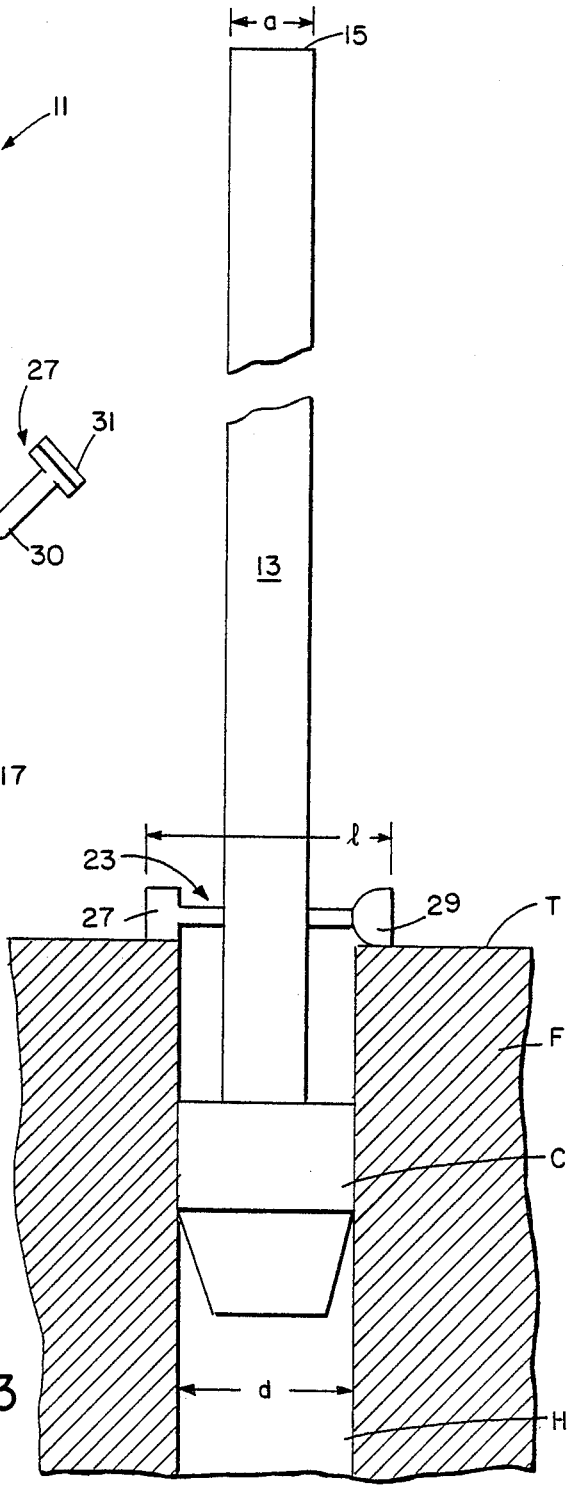
FIG. 3 is a view partly in section, illustrating how the device in FIG. 1 is used to insert a cork plug into a hole made in a concrete foundation of a building.

Referring now to the drawings and first to FIGS. 1 to 3, there is illustrated a device 11 constructed according to one embodiment of the present invention.

Device 11 includes an elongated rod 13, which is made of wood, plastic, metal or other suitable material. Rod 13, which is cylindrical in shape, has a length r and a cross-sectional diameter a, wherein a is less than the cross-sectional diameter d of a hole H made in a concrete foundation F of a building (see FIG. 3). Rod 13 has a back or top end 15 and a bottom or front end 17. In use, rod 17 is inserted into hole H with the front end 17 first. A pin 19 for holding a cork plug C (See FIG. 3) is fixedly mounted in an axial hole (not shown) made on the bottom end 17 or rod 13. Pin 19, which is made of metal or other suitable material, has a portion extending out from rod 13 on which cork plug C may be securely mounted. Instead of having pin 19 fixedly mounted on bottom end 17, device 11 may be constructed so that pin 19 is removably mounted on bottom end of rod 13. This may be achieved, for example, by making the inner end of pin 19 threaded and then inserting that threaded end into an internally threaded longitudinal hole bored (not shown) in bottom end 17.

Rod 13 includes a plurality of transverse holes 23-1, 23-2, 23-3, 23-4, 23-5, and 23-6. Holes 23 are uniformly spaced along the longitudinal axis of rod 13 so that the distance from any particular hole to bottom end 17 can be easily ascertained. In the embodiment shown in FIGS. 1–3, there are six holes which are disposed along the longitudinal axis of rod 13. However, it is to be understood that the particular number of holes is by way of example only and may vary without departing from the scope of the invention.

Depth-setting means 25 are provided for limiting the amount by which rod 13 may be inserted into hole H. Depth-setting means 25 includes a depth-setting pin 27 and a cap 29. Depth-setting pin 27, which is made of wood, plastic or other suitable material, has an elongated body 30 and a head 31. Elongated body 30 is smaller in cross-section than holes 23 while head 31 is larger in cross-section than holes 23. Cap 29, which is made of plastic, rubber or other suitable material, is larger in cross-section than holes 23. Therefore, by inserting elongated body 30 of depth-setting pin 27 through any of transverse holes 23 and then mounting depth-setting cap 29 on elongated body 30 at the end opposite head 31, it becomes possible to securely mount depth-setting pin 27 in any one of transverse holes 23. When so assembled, depth-setting pin 27 and cap 29 are disposed perpendicular to rod 23 and have an aggregate length l (see FIG. 2), which is greater than d, the diameter of hole H.

Since rod 13 is smaller in cross-sectional size than hole H and the pin 27 and cap 29 combination is larger than hole H, when rod 13 is inserted into hole H, the front end first, it will penetrate hole H until pin 27 strikes the top T of the foundation (as shown in FIG. 3).

The specific dimensions of device 11 may vary, depending on the diameter of the hole being plugged. For example, if diameter d of hole H is 0.5 inch, then acceptable dimensions for diameter a, length r, and length l may be 0.375 inches, 3 feet, and 1 inch, respectively.

Figure 4:
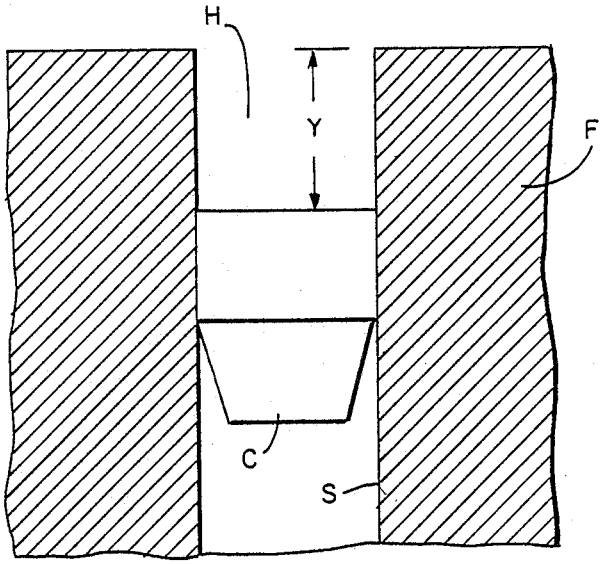
FIG. 4 is a view partly in section of a hole made in the concrete foundation of a building and a cork plug inserted therein to a predetermined depth.

The manner of using device 11 will now be described. First, a user decides to what depth cork plug C is to be inserted into hole H. After deciding on a depth, the user then inserts depth-setting pin 27 into the particular transverse hole 25 that will produce the desired result. Depth-setting cap 29 is then mounted on elongated body 30 of depth-setting pin 27, thereby securing depth-setting pin 27 in transverse hole 23. Cork plug C, which has a cross-sectional diameter slightly greater than that of hole H, is then mounted on pin 19 and pushed up until it strikes end 17 of rod 13. The user then inserts rod 13 into hole H, the end containing cork plug C first and pushes down on rod 13, thereby forcing cork plug C down into hole H. Because depth-setting means 23 is larger in length than the diameter of hole H, rod 13 will not be inserted into hole H past depth-setting means 23. Cork plug C is now in frictional engagement with the sidewall S of hole H and is at the pre-determined depth. The user then lifts device 11 out of hole H. Because of the frictional engagement, cork plug C will remain in hole H at the desired depth Y, as shown in FIG. 4.

Figure 5:
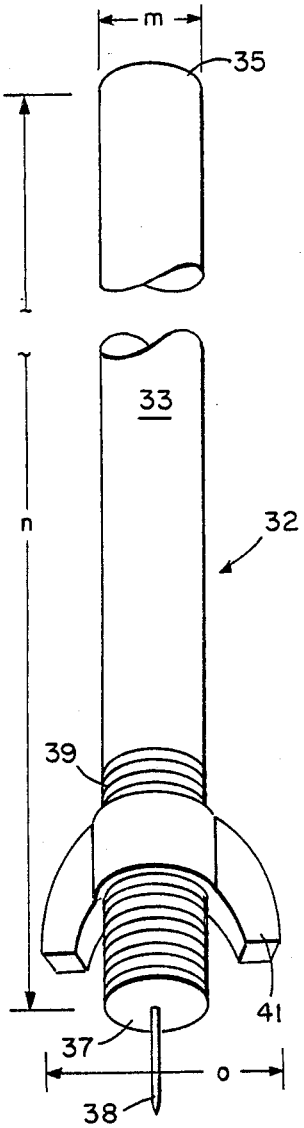
FIG. 5 is a perspective view of a variation of the device shown in FIG. 1.

Referring now to FIG. 5, there is illustrated a variation of device 11, the variation being generally designated as device 32. Device 32 is similar in many respects to device 11, and includes an elongated rod 33 having a top end 35 and a bottom end 37, the cross-sectional diameter m of rod 33 being less than the cross-sectional diameter d of hole H. Rod 33, which s similar in composition to rod 13, has a length n. A pin 38, identical to pin 19 in terms of shape, size, and composition, is fixedly mounted on bottom end 37. As was the case for device 11, pin 38 may be made removably mounted on bottom end 37 by threading one end of pin 38 and then inserting the threaded portion into an internally threaded hole bored in bottom end 37.

Rod 33 does not have a plurality of transverse holes disposed along its longitudinal axis but, rather, has an externally threaded region 39 extending from bottom end 37. Also, instead of including a depth-setting pin and cap, the depth-setting means for device 32 comprises a winged nut 41 for threaded engagement on externally threaded region 39. Winged nut 41 has a length o which is greater than the diameter of hole H.

As is the case for device 11, the dimensions of device 31 may vary, depending on the diameter of the hole being plugged. If, for example, diameter d of hole H is 0.5 inches, acceptable dimensions for diameter a, length r, and length l may be 0.375 inches, 3 feet, and 1 inch, respectively.

The operation of device 32 is basically the same as that of device 11, the principal difference being the setting of the depth-setting means. After deciding on a depth, the user screws winged nut 41 to that point on externally threaded region 39 which will cause cork plug C to be positioned at the pre-determined depth. Device 32 is then used in the same fashion as device 11.

Figure 6:
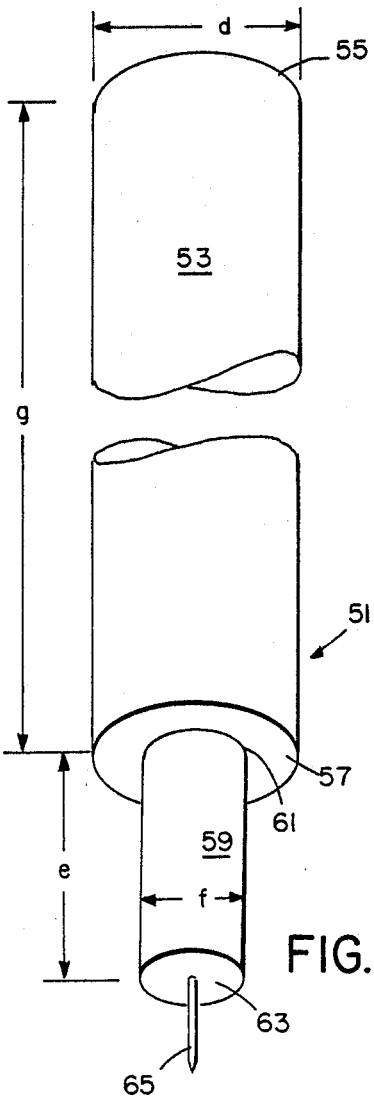
FIG. 6 is a perspective view of a device for inserting a cork plug into a hole in the concrete foundation of a building to a pre-determined depth constructed according to another embodiment of the present invention.

Referring now to FIG. 6, there is illustrated another embodiment of a device for inserting a cork plug into a hole constructed according to the teachings of the present invention and designated generally by reference numeral 51.

Device 51 includes a rod 53, which is made of wood, plastic, or other similar material. Rod 53, which is cylindrical in shape, has a length g and a cross-sectional diameter b wherein b is greater than d, the cross-sectional diameter of hole H. Rod 53 has a top end 55 and a bottom end 57. An extension piece 59 for insertion into hole H is mounted to bottom end 57 of rod 53. Extension piece 59, which is cylindrical in shape, is made of wood, plastic, or other suitable material. Extension piece 59 has a length e and a cross-sectional diameter f wherein f is less than d, the cross-sectional diameter of hole H. Extension piece 59 has a top end 61 and a bottom end 63. Top end 61 is fixedly mounted to bottom end 57 of rod 53 by means of glue or other suitable material (not shown). Alternatively, extension piece 59 could be made removably mounted to rod 53 by mounting a screw on top end 61 of extension piece 59 and then screwing extension piece 59 into an internally threaded hole bored in bottom end 57 of rod 53. Such an arrangement would enable a user to select an extension piece of desired length for mounting on rod 53. A pin 65 for mounting cork plug C is fixedly mounted on bottom end of extension piece 59 by means of glue or other suitable material (not shown). Pin 65, which is made of metal or other suitable material, has a length of about 0.5 inch but need only be long enough to securely mount a cork plug C. Rather than being fixedly mounted to extension piece 59, pin 65 could be made removably mounted to extension piece 59 in the same manner as detailed for pin 19 and rod 13 of device 11.

The specific dimensions of device 51 vary depending on the diameter of the hole being plugged. For example, if diameter d of hole H is 0.5 inch, acceptable dimensions for diameter b, diameter f, length g, and length e are 1 inch, 0.25 inch, 3 feet, and 1 inch, respectively.

To operate device 51, the user inserts pin 65 into cork plug C until cork plug C lies flush with bottom end 63 of extension piece 59. Cork plug C is now mounted on device 51 and is ready to be inserted. The user then centers cork plug C over hole H and inserts device 51 into hole H. Because rod 53 is too large to be inserted into hole H, cork plug C is inserted in hole H to a depth equal to e, the length of extension piece 59. With cork plug C securely in place due to friction, the user withdraws pin 65 from cork plug C by pulling up on rod 53.

Figure 7:
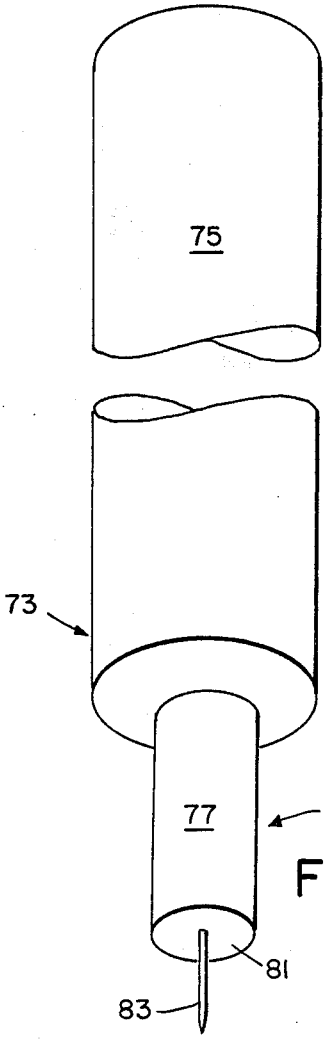
FIG. 7 is a perspective view of a device for inserting a cork plug into a hole in the concrete foundation of a building to a pre-determined depth constructed according to still another embodiment of the present invention.

Referring now to FIG. 7, there is illustrated another embodiment of a device for inserting a cork plug into a hole constructed according to the teachings of the present invention and designated generally by reference numeral 71.

Device 71 includes a rod 73, made of wood, plastic, or other suitable material. Rod 73, which is a unitary structure, includes an upper region 75, a lower region 77, a top end 79, and a bottom end 81. Upper region 75 and lower region 77 are both cylindrical in shape, upper region 75 having dimensions identical to rod 53 of device 51 and lower region 77 having dimensions identical to extension piece 59 of device 51. A pin 83 for mounting a cork plug C is fixedly mounted to bottom end 81 by means of glue or other suitable material. Alternatively, in the manner described for device 51, pin 83 can be made removably mounted to bottom end 81.

The operation of device 71 is identical to that of device 51.

The embodiments of the present invention are intended to be merely exemplary and those skilled in the art shall be able to make numerous variations and modifications to it without departing from the spirit of the present invention as defined in the appended claims.

What is claimed is:

1. A device to assist a person in inserting a cork plug into a hole made in the concrete foundation of a building from a standing position, the hole being made for termite control purposes, said hole having a diameter d, said device comprising:

a. an elongated rod, said rod having a cross-sectional diameter less than d and including:
   i. a bottom end, and
   ii. a top end, the length of the rod being such that a person can insert the bottom end into the hole from a standing position, b. pin means on said bottom end of said rod for mounting a cork plug thereto, said pin extending outward therefrom, and c. depth-setting means mounted on said rod for limiting the extent to which said rod may be inserted into said hole.

2. The device of claim 1 and wherein said rod has a plurality of transverse holes disposed along its length and wherein said depth-setting means includes a depth-setting pin removably mounted in a pre-selected one of said holes.

3. The device of claim 2 and wherein said depth-setting pin has an elongated body for insertion into said transverse holes and a head sized greater than said transverse holes for use in securing said depth-setting pin in said transverse holes.

4. The device of claim 3 and wherein said depth-setting means also includes a cap removably mounted on said depth-setting pin, said cap being sized greater than said transverse holes.

5. The device of claim 4 and wherein said transverse holes are uniformly spaced so that the distance from said transverse holes to said bottom end may be easily ascertained.

6. The device of claim 1 and wherein said rod has an externally threaded region and wherein said depth-setting means includes a nut in threaded engagement with said externally threaded region.

7. The device of claim 6 and wherein said nut is a winged nut.

8. The device of claim 1 and wherein said rod has a length of about 3 feet.

9. A device to assist a person in inserting a cork plug into a hole to a pre-determined depth from a standing position, said hole having a diameter d and having been made in the concrete foundation of a building for termite control purposes, said device comprising:

a. a rod having:
   i. a bottom end and
   ii. a cross-sectional diameter greater than d,
b. an extension piece extending out from said bottom end of said rod for insertion into said hole, said extension piece having:
   i. a top end,
   ii. a bottom end, and
   iii. a cross-sectional diameter less than d, and
c. a pin mounted on said bottom end of said extension piece for mounting a cork plug thereto, said pin extending outward therefrom.

10. The device of claim 9 and wherein said top end of said extension piece is fixedly mounted to said bottom end of said rod.

11. The device of claim 10 and wherein said rod has a length of about 3 feet.

12. The device of claim 9 and wherein said rod and said extension piece are a unitary structure.

13. A device to assist a person inserting a cork plug into a hole to a pre-determined depth from a standing position, said hole having a diameter d and having been made in the concrete foundation of a building for termite control purposes, said device comprising:

a. a rod having:
   i. a bottom end,
   ii. an upper region with cross-sectional diameter greater than d, and
   iii. a lower region with cross-sectional diameter less than d for insertion into said hole, and
b. a pin mounted on said bottom end of said rod for mounting a cork plug thereto, said pin extending outward therefrom.

14. The device of claim 13 and wherein said upper region has a length of 3 feet.

15. A method to assist a person in inserting a cork plug into a hole drilled in the concrete foundation of a building for termite control purposes from a standing position, said method comprising the steps of:

a. providing an elongated device having a pin at one end and which can be inserted into said hole to a pre-determined depth by said person from a standing position,
b. mounting a cork plug onto the end of said device having said pin,
c. inserting said device into said hole to said pre-determined depth, said end containing said cork plug first, said cork plug frictionally engaging said hole, and then,
d. removing said device from said hole,
e. whereby, said cork plug will remain in said hole at said pre-determined depth.

* * * * *